US009182689B2

(12) United States Patent
Kamiwaki et al.

(10) Patent No.: US 9,182,689 B2
(45) Date of Patent: Nov. 10, 2015

(54) ELECTROSTATIC IMAGE DEVELOPING TONER, ELECTROSTATIC IMAGE DEVELOPER, TONER CARTRIDGE, PROCESS CARTRIDGE, IMAGE FORMING METHOD, AND IMAGE FORMING APPARATUS

(75) Inventors: Satoshi Kamiwaki, Kanagawa (JP); Susumu Yoshino, Kanagawa (JP); Masanobu Ninomiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 589 days.

(21) Appl. No.: 12/430,623

(22) Filed: Apr. 27, 2009

(65) Prior Publication Data

US 2010/0099038 A1 Apr. 22, 2010

(30) Foreign Application Priority Data

Oct. 20, 2008 (JP) ..... 2008-269391

(51) Int. Cl.

| | |
|---|---|
| ***G03G 9/00*** | (2006.01) |
| ***G03G 9/08*** | (2006.01) |
| ***G03G 8/00*** | (2006.01) |
| ***G03G 9/087*** | (2006.01) |
| ***G03G 9/09*** | (2006.01) |

(52) U.S. Cl.

CPC ..... *G03G 9/0821* (2013.01); *G03G 8/00* (2013.01); *G03G 9/08797* (2013.01); *G03G 9/0926* (2013.01)

(58) Field of Classification Search

CPC ... G03G 9/08; G03G 9/0821; G03G 9/08797; G03G 9/0926

USPC ..... 430/108.1, 108.2, 108.21, 109.4

See application file for complete search history.

(56) References Cited

U.S. PATENT DOCUMENTS

| | | | | |
|---|---|---|---|---|
| 4,521,556 | A * | 6/1985 | Adams | 524/88 |
| 5,780,191 | A | 7/1998 | Ide | |
| 5,915,144 | A | 6/1999 | Ide et al. | |
| 5,981,121 | A | 11/1999 | Ide | |
| 6,497,950 | B1 * | 12/2002 | Haile et al. | 428/364 |
| 2004/0132920 | A1 * | 7/2004 | Matsumura et al. | 525/418 |
| 2006/0160009 | A1 * | 7/2006 | Padunchwit et al. | 430/108.23 |
| 2007/0048653 | A1 | 3/2007 | Ide | |

FOREIGN PATENT DOCUMENTS

| | | |
|---|---|---|
| EP | 0 629 921 A1 | 12/1994 |
| JP | A-2-201453 | 8/1990 |
| JP | A-8-220821 | 8/1996 |
| JP | A-10-123863 | 5/1998 |
| JP | A-09-197858 | 7/1998 |
| JP | A-11-7174 | 1/1999 |

(Continued)

OTHER PUBLICATIONS

Japanese Office Action dated Aug. 31, 2010 in Japanese Patent Application No. 2008-269391 (with translation).

(Continued)

*Primary Examiner* — Jonathan Jelsma
(74) *Attorney, Agent, or Firm* — Oliff PLC

(57) ABSTRACT

An electrostatic image developing toner includes a binder resin; and a pigment having a complementary relationship with a color hue of the binder resin, the pigment being contained in an amount of about 1 ppm or greater but not greater than about 20 ppm.

10 Claims, 1 Drawing Sheet

(56) References Cited

FOREIGN PATENT DOCUMENTS

| | | |
|---|---|---|
| JP | A-2001-175022 | 6/2001 |
| JP | A-2008-129410 | 6/2008 |
| JP | A-2008-209807 | 9/2008 |

OTHER PUBLICATIONS

European Search Report issued on Feb. 12, 2010 in European Patent Application No. 09160116.1.

* cited by examiner

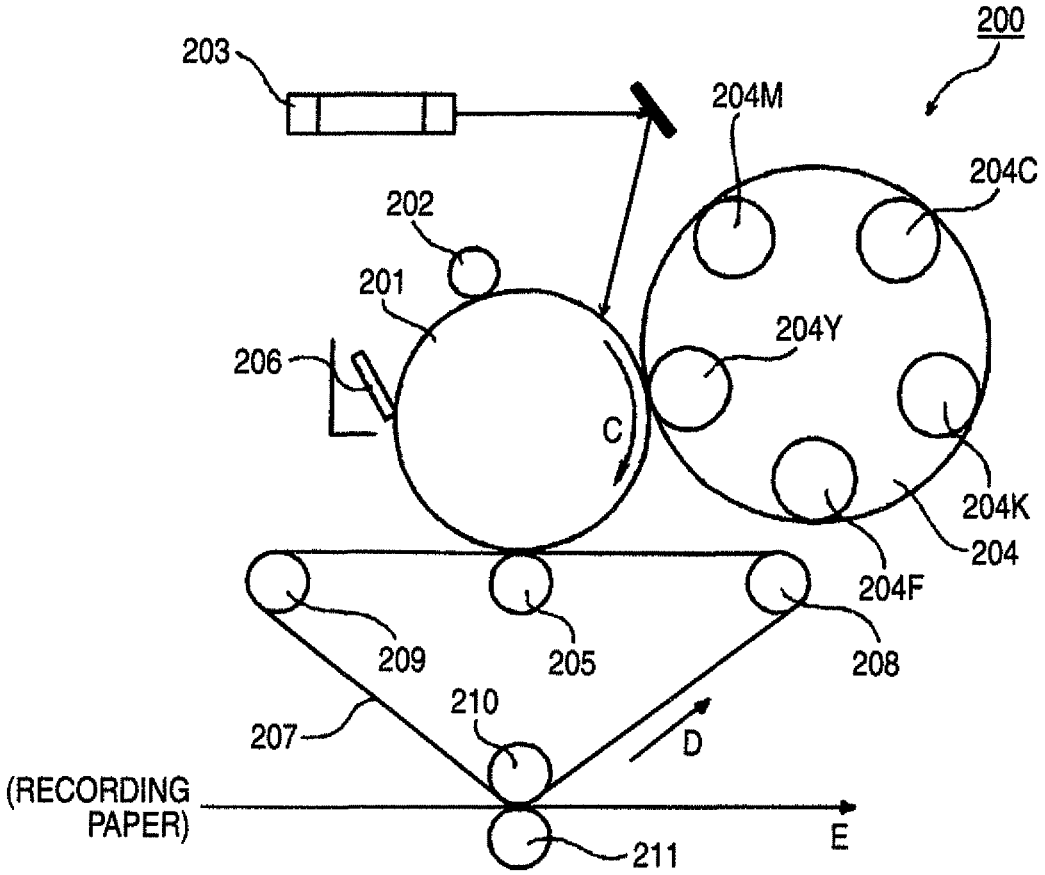
200
203
204M
204C
202
201
204Y
206
C
204K
204
204F
209
205
208
210
207
D
(RECORDING PAPER)
E
211

ELECTROSTATIC IMAGE DEVELOPING TONER, ELECTROSTATIC IMAGE DEVELOPER, TONER CARTRIDGE, PROCESS CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2008-269391 filed on Oct. 20, 2008.

BACKGROUND

1. Technical Field

The present invention relates to an electrostatic image developing toner, an electrostatic image developer, a toner cartridge, a process cartridge, an image forming method, and an image forming apparatus.

2. Related Art

In electrophotography, an image is formed by forming an electrostatic image on a photoreceptor in charging and exposure steps, developing an electrostatic latent image with a developer containing a toner, thereby forming a toner image, transferring and fixing the toner image to a recording medium. As the developer in this image formation, a two-component developer composed of a toner and a carrier and a one-component developer using a magnetic toner or a non-magnetic toner singly are usable. As a preparation process of a toner, proposed are a so-called kneading and grinding process in which a thermoplastic resin is melted and kneaded with a pigment, a charge controller, and a releasing agent such as wax, and after cooling, the kneaded mass is finely ground and classified and a toner preparation process utilizing a wet process as a means capable of intentionally controlling the shape or surface structure of a toner. Examples of the wet process include wet spheronization capable of controlling a shape of a toner, suspension granulation capable of controlling its surface composition, and suspension polymerization or aggregation/coalescence capable of controlling its internal composition.

On the other hand, depending on the unevenness of a toner or a recording medium itself, or the density of a toner image, the luster, granularity, or color tone of the resulting image sometimes vary.

SUMMARY

According to an aspect of the invention, there is provided an electrostatic image developing toner including a binder resin; and a pigment having a complementary relationship with a color hue of the binder resin, the pigment being contained in an amount of about 1 ppm or greater but not greater than about 20 ppm.

BRIEF DESCRIPTION OF THE DRAWINGS

Exemplary embodiments of the present invention will be described in detail based on the following figures, wherein:

FIG. 1 is a schematic view illustrating one example of the constitution of an image forming apparatus to be used for the image forming method of the present invention, wherein

200 denotes Image forming apparatus, 201 denotes Image holding member, 202 denotes Charger, 203 denotes Image writing apparatus, 204 denotes Rotary developing device, 204Y, 204M, 204C, 204K and 204F denote Developing device, 205 denotes Primary transfer roll, 206 denotes Clearing blade, 207 denotes Intermediate transfer member, 208, 209 and 210 denotes Supporting roll, 210 denotes Supporting roll, and 211 denotes Secondary transfer roll.

DETAILED DESCRIPTION

<Electrostatic Image Developing Toner>

The electrostatic image developing toner (which may hereinafter be called "toner", simply) according to the present exemplary embodiment contains a binder resin, a releasing agent, and a pigment having a complementary relationship with the color hue of the binder resin and it contains the pigment in an amount of about 1 ppm or greater but not greater than about 20 ppm. When the pigment having a complementary relationship with the color hue of the binder resin is contained in an amount less than 1 ppm based on the total amount of the toner, the color hue of the binder resin appears and a color difference ΔE*ab between a toner (for example, so-called invisible toner) image region and an exposed region of a recording medium after the toner is fixed on the recording medium exceeds 5 so that a viewer feels a difference in the color tone between the toner image region and the exposed region of the recording medium. When the pigment having a complementary relationship with the color hue of the binder resin is contained in an amount of 20 ppm or greater based on the total amount of the toner, on the other hand, the color of the pigment appears and the color difference ΔE*ab between a toner (for example, so-called invisible toner) image region and an exposed region of a recording medium after the toner is fixed onto the recording medium exceeds 5 so that similar to the above case, a viewer feels a difference in the color tone between the toner image region and the exposed region of the recording medium. The color difference ΔE*ab is determined, in an L*a*b* color system, from $\Delta E^*ab=[(\Delta a^*)^2+(\Delta b^*)^2+(\Delta L^*)^2]^{1/2}$.

The term "complementary colors" means a pair of colors completely opposite to each other in a color circle. The term "pigment having a complementary relationship with the color hue of a binder resin" as used herein means, in the above L*a*b* color system, a pigment having a color hue in a blue direction from −0.9 to 1.1b* when the color hue of the binder resin is in a yellow direction +b* and having a color hue in a yellow direction from +0.9 to 1.1b* when the color hue of the binder resin is a blue direction −b*. Similarly, it means a pigment having a color hue in a red direction from +0.9 to 1.1a* when the color hue of the binder resin is in a green direction −a* and having a color hue in a green direction from −0.9 to 1.1a* when the color hue of the binder resin is in a red direction +a*.

The electrostatic image developing toner according to the present exemplary embodiment, on the other hand, contains a binder resin, a releasing agent, and a pigment having a complementary relationship with the color hue of the resin; and in this toner, a color difference ΔE*ab between a recording medium and a toner image after the toner is fixed onto the recording medium at a toner amount of 10 g/m$^2$ is about 5 or less, preferably about 3 or less. As described above, when the color difference ΔE*ab between a toner (for example, so-called invisible toner) image region and an exposed region of the recording medium after the toner is fixed onto the recording medium exceeds 5 , a viewer feels a difference in the color tone between the toner image region and the exposed region of the recording medium.

[Binder Resin]

The binder resin contained in the toner of the present exemplary embodiment is a polyester resin. The polyester resin contains at least an amorphous polyester resin and a crystalline polyester resin. The binder resin in the toner of the present exemplary embodiment contains a polyester resin in an amount of about 70 mass % or greater but not greater than about 100 mass %.

In the toner of the present exemplary embodiment, the binder resin contains a crystalline polyester resin in an amount of about 1 mass % or greater but not greater than about 30 mass %. When the binder resin contains a crystalline polyester resin in an amount less than 1 mass %, the content of an amorphous polyester resin in the binder resin increases, resulting in appearance of the color hue of the amorphous polyester resin, and as described above, a color difference ΔE*ab between a toner (for example, so-called invisible toner) image region and an exposed region of the recording medium after the toner is fixed onto the recording medium exceeds 5. When the binder resin contains a crystalline polyester resin in an amount exceeding 30 mass %, on the other hand, the content of the crystalline polyester resin in the binder resin increases, resulting in appearance of the color hue, that is, white color of the crystalline polyester resin and as described above, the color difference ΔE*ab between a toner (for example, so-called invisible toner) image region and an exposed region of the recording medium after the toner is fixed onto the recording medium exceeds 5. As will be described later, a color, for example, a tinge of yellow of the amorphous polyester resin derived from a catalyst, especially, a titanium catalyst, used in preparation of the amorphous polyester resin appears. Examples of the titanium catalyst include titanium tetraethoxide, titanium teterapropoxide, titanium tetraisopropoxide, and titanium tetrabutoxide.

The polyester resin to be used as the binder resin in the toner of the present exemplary embodiment has a bisphenol skeleton. The bisphenol skeleton is derived from an aliphatic diol used when the amorphous polyester resin is prepared and has the following structure.

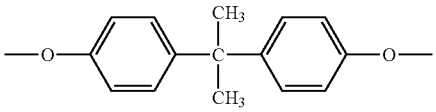

Components constituting the toner of the present exemplary embodiment will next be described specifically.

—Crystalline Polyester Resin—

The crystalline polyester resin to be used in the invention will next be described. The term "crystalline polyester resin" as used herein means a resin having a definite endothermic peak in differential scanning calorimetry (DSC). The term "crystalline" used with regard to the electrostatic image developing toner of the invention means that the resin has a definite endothermic peak in differential scanning calorimetry (DSC), more specifically, has a half width of an endothermic peak, as measured at a heating rate of 10° C./min, within 6° C.

The weight average molecular weight (Mw) of the crystalline polyester resin is preferably 4000 or greater, more preferably 6000 or greater. When the weight average molecular weight (Mw) is less than 4000, the toner may penetrate into the surface of a recording medium such as paper during fixing, thereby causing uneven fixing or deteriorating the bending resistance of a fixed image.

The crystalline polyester is synthesized from an acid (dicarboxylic acid) component and an alcohol (diol) component. The acid (dicarboxylic acid) component and the alcohol (diol) component will hereinafter be described in further detail. In the invention, a copolymer obtained by copolymerization of, with a crystalline polyester serving as a main chain, another component in an amount of 50 mass % or less is also embraced in the category of the crystalline polyester.

The crystalline polyester preferably contains an aliphatic dicarboxylic acid as the acid (dicarboxylic acid) component. Examples include, but not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,10-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof.

The crystalline polyester may contain, as well as the above aliphatic dicarboxylic acid component, a constituent component of a dicarboxylic acid component having a double bond as the acid (dicarboxylic acid) component. The dicarboxylic acid components having a double bond include, as well as a constituent component derived from a dicarboxylic acid having a double bond, a constituent component derived from a lower alkyl ester or acid anhydride of a dicarboxylic acid having a double bond.

The dicarboxylic acid having a double bond can be used preferably in order to achieve satisfactory fixing strength because an entire resin can be crosslinked by using the double bond therein. Examples of such a dicarboxylic acid include, but not limited to, fumaric acid, maleic acid, 3-hexenedioic acid, and 3-octenedioic acid. Additional examples include lower alkyl esters, and acid anhydrides thereof. Examples of the divalent carboxylic acid component which may be contained in the carboxylic acid component other than aliphatic dicarboxylic acid compounds include aromatic carboxylic acids such as phthalic acid, isophthalic acid, and terephthalic acid, alicyclic carboxylic acids such as cyclohexanedicarboxylic acid, and anhydrides or $C_{1-3}$ alkyl esters of these acids. Examples of the trivalent or higher valent carboxylic acids include aromatic carboxylic acids such as 1,2,4-benzenetricarboxylic acid (trimellitic acid), 2,5,7-naphthalenetricarboxylic acid, 1,2,4-naphthalenetricarboxylic acid, and pyromellitic acid, aliphatic carboxylic acids such as 1,2,4-butanetricarboxylic acid, 1,2,5-hexanetricarboxylic acid, 1,3-dicarboxyl-2-methyl-2-methylenecarboxypropane, tetra (methylenecarboxyl)methane, and 1,2,7,8-octanetetracarboxylic acid, and alicyclic carboxylic acids such as 1,2,4-cyclohexanetricarboxylic acid, and derivatives of these acids such as acid anhydrides and $C_{1-3}$ alkyl esters.

On the other hand, the crystalline polyester preferably contains an aliphatic alcohol as the alcohol (diol) component. Examples include, but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol.

A diol having a double bond or a trihydric or higher hydric alcohol may be contained as needed as the constituent component.

Examples of the diol having a double bond include 2-butene-1,4-diol, 3-butene-1,6-diol, and 4-butene-1,8-diol. Examples of the trihydric or higher hydric alcohol include aromatic alcohols such as 1,3,5-trihydroxymethylbenzene, aliphatic alcohols such as sorbitol, 1,2,3,6-hexanetetrol, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, and trimethylolpropane, and alicyclic alcohols such as 1,4-sorbitan.

No particular limitation is imposed on the preparation process of the crystalline polyester resin and it can be prepared by reacting a carboxylic acid component and an alcohol component in accordance with the conventional polyester polymerization process. Examples of such a process include direct polycondensation and ester exchange. An appropriate process is selected, depending on the kind of the monomers. A molar ratio (acid component/alcohol component) when the acid component and the alcohol component are reacted cannot be set in a wholesale manner because it varies, depending on reaction conditions and the like. However, it is typically about 1/1.

The crystalline polyester can be prepared at a polymerization temperature ranging from 180 to 230° C. and if necessary, the polymerization reaction is performed while reducing the pressure in the reaction system and removing water or alcohol generated during condensation. When the monomer does not show solubility or compatibility under a reaction temperature, a high-boiling-point solvent may be added as a dissolution aid to cause dissolution. The polycondensation reaction is performed while distilling off the dissolution aid. When a monomer having poor compatibility is present in the copolymerization reaction, it is recommended to condense the monomer, which has poor compatibility, with a carboxylic acid component or an alcohol component to be polycondensed with the monomer in advance and then carry out polycondensation with the main component.

Examples of the catalyst usable upon preparation of the crystalline polyester resin include alkali metal compounds such as sodium and lithium, alkaline earth metal compounds such as magnesium and calcium, metal compounds with zinc, manganese, antimony, titanium, tin, zirconium, germanium, or the like, phosphorous acid compounds, phosphoric acid compounds, and amine compounds. Following are specific examples of the catalyst.

Examples include sodium acetate, sodium carbonate, lithium acetate, calcium acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octoate, germanium oxide, triphenyl phosphite, tris(2,4-di-t-butylphenyl)phosphite, ethyltriphenyl phosphonium bromide, triethylamine, and triphenylamine.

In order to sequester a polar group at a terminal of the crystalline polyester resin and improve the environment stability of the charging characteristic of the toner, a monofunctional monomer may be introduced into the crystalline polyester resin.

Examples of the monofunctional monomer include monocarboxylic acids such as benzoic acid, chlorobenzoic acid, bromobenzoic acid, monoammonium sulfobenzoate, monosodium sulfobenzoate, cyclohexylaminocarbonylbenzoic acid, n-dodecylaminocarbonylbenzoic acid, tertiary butylbenzoic acid, naphthoeic acid, 4-methylbenzoic acid, 3-methylbenzoic acid, salicylic acid, thiosalicylic acid, phenylacetic acid, acetic acid, propionic acid, butyric acid, isobutyric acid, octane carboxylic acid, lauric acid and stearic acid, and lower alkyl esters thereof; and monohydric alcohols such as aliphatic alcohols, aromatic alcohols, and alicyclic alcohols.

—Amorphous Polyester Resin—

As the amorphous polyester resin to be used for the toner of the present exemplary embodiment, known amorphous polyester resins are used.

The amorphous polyester resin has a glass transition temperature (Tg) of preferably 45° C. or greater but not greater than 85° C., more preferably 50° C. or greater but not greater than 75° C. The glass transition temperatures (Tg) below 45° C. may make it difficult to store the toner. The glass transition temperatures exceeding 85° C., on the other hand, may increase an energy consumed for fixation.

The weight average molecular weight (Mw) of the amorphous polyester resini is preferabaly 5000 or greater but not greater than 100000 . The weight average molecular weight (Mw) is more preferably 8000 or greater but not greater than 50000 from the standpoint of low-temperature fixaing and mechanical strength.

Similar to the preparation process of the crystalline polyester resin, no particular limitation is imposed on the preparation process of the amorphous polyester resin. The conventional polyester polymerization process may be employed therefor as in the preparation of the crystalline polyester resin.

As the acid (dicarboxylic acid) component to be used for the synthesis of the amorphous polyester resin, various dicarboxylic acids exemplified above for the crystalline polyester resin can be used similarly. Particularly preferred are dicarboxylic acids such as phthalic acid, isophthalic acid, terephthalic acid, fumaric acid, and maleic acid; succinic acid, trimellitic acid, or pyromellitic acid substituted with a $C_{1-20}$ alkyl group or $C_{2-20}$ alkenyl group such as dodecenylsuccinic acid and octylsuccinic acid; and anhydrides or $C_{1-3}$ alkyl esters of these acids. Also as the alcohol (diol) component, various diols can be used for the synthesis of the amorphous polyester resin. Examples include, in addition to the aliphatic diols exemplified above for the crystalline polyester resin, bisphenol A added with a $C_{2-3}$ alkylene oxide (average moles added: from 1 to 10) such as polyoxypropylene (2,2)-2,2-bis(4-hydroxyphenyl)propane and polyoxyethylene (2,2)-2,2-bis(4-hydroxyphenyl)propane, and hydrogenated bisphenol A. The amorphous polyester may contain a plurality of these acid (dicarboxylic acid) components or a plurality of these alcohol components.

Similar to the above crystalline polyester resin, in order to sequester a polar group at a terminal of the amorphous polyester resin and improve the environment stability of the charging characteristic of the toner, a monofunctional monomer may be introduced into the amorphous polyester resin. As the monofunctional monomer, various compounds exemplified above for the crystalline polyester resin can be used.

Examples of another binder resin to be used for the toner include homopolymers and copolymers of styrenes such as styrene and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylic esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Particularly typical examples of the binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene. Further examples include polyester, polyurethane, epoxy resin, silicone resin, polyamide, modified rosin, and paraffin wax.

[Pigments having a Complementary Relationship with the Color Hue of a Binder Resin]

As described above, the term "complementary colors" means a pair of colors that are completely opposite to each other in a color circle and the term "pigment having a complementary relationship with the color hue of a binder resin" means a pigment, for example, having, in the above L*a*b* color system, a color hue in a blue direction −b* when the color hue of the polyester resin prepared using the above titanium catalyst is in a yellow direction +b*.

The above pigment having a color hue in a blue direction −b* is a pigment tinged with blue and examples include copper phthalocyanine, cobalt blue, and cobalt aluminate. At least one pigment selected from the group consisting of copper phthalocyanine, cobalt blue, and cobalt aluminate is contained in the toner in an amount of 1 ppm or greater but not greater than 20 ppm, preferably 1 ppm or greater but not greater than 10 ppm. When the pigment content is below the above range, the yellowish color hue of the binder resin in the toner appears. When the pigment content exceeds the above range, on the other hand, bluish color hue of the pigment appears. In any case, a color difference ΔE*ab between a toner (for example, so-called invisible toner) image region and an exposed region of the recording medium after the toner is fixed onto the recording medium exceeds 5 and as described above, a viewer feels a difference in the color tone between the toner image region and the exposed region of the recording medium.

The bluish pigment is preferably copper phthalocyanine from the standpoint of an effect for imparting ultraviolet light resistance to the toner.

[Releasing Agent]

Examples of the releasing agent include low molecular weight polyolefins such as polyethylene, polypropylene, and polybutene; silicones that shows a softening point upon heating; aliphatic amides such as oleic amide, erucic amide, ricinoleic amide, and stearic amide; vegetable waxes such as carnauba wax, rice wax, candelilla wax, Japan wax, and jojoba oil; animal waxes such as beeswax; mineral/petroleum waxes such as Montan wax, ozokerite, ceresin, paraffin wax, microcrystalline wax, and Fischer-Tropsch wax; and ester waxes such as fatty acid esters, montanates, and carboxylates; and modified derivatives thereof. These releasing agents may be used either singly or in combination. As the releasing agent in the present exemplary embodiment, low molecular polyolefins are preferred, with white polyester being more preferred.

[External Additives]

In order to give fluidity or improve a cleaning property, a metal salt such as calcium carbonate, a metal oxide compound such as silica, alumina, titania, barium titanate, strontium titanate, calcium titanate, cerium oxide, zirconium oxide, or magnesium oxide, inorganic particles such as ceramic, or resin particles such as vinyl resin, polyester or silicone may be added, as in the conventional toner preparation, to the toner surface while applying a shear force under dry condition.

These inorganic particles are preferably surface treated with a coupling material or the like to control conductivity, charge property or the like. Specific examples of the coupling material include silane coupling agents such as methyltrichlorosilane, methyldichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethylsilazane, N,N-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane; and titanium coupling agents.

As the addition method of these particles, either a method of drying a toner and then attaching the particles onto the surface of the toner in a dry system by using a mixer such as V blender or Henschel mixer or a method of dispersing the particles in water or a aqueous liquid such as water/alcohol, adding the resulting dispersion to a toner in a slurry form, drying the toner, and attaching the external additive to the toner surface. Drying may be carried out while spraying the slurry to the dried powder.

<Electrostatic Image Developing Toner>

As the carrier usable for two-component developer, any conventional carrier may be used without any particular limitation. Examples of the carrier may include magnetic metals such as iron oxide, nickel, and cobalt, magnetic oxides such as ferrite and magnetite, resin-coat carriers having a resin coating layer on the surface of each of these core materials, and magnetic dispersion type carriers. Also, a resin dispersion type carrier obtained by dispersing a conductive material or the like in a matrix resin can be used.

Examples of the coating resin/matrix resin used for the carrier may include, though not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride/vinyl acetate copolymer, styrene/acrylic acid copolymer, straight silicone resin made of an organosiloxane bond or modified product thereof, fluororesin, polyester, polycarbonate, phenolic resin, and epoxy resin.

Examples of the conductive material may include, though not limited to, metals such as gold, silver, and copper, carbon black and further, titanium oxide, zinc oxide, barium sulfate, aluminum borate, potassium titanate, and tin oxide.

Examples of the core material of the carrier include magnetic metals such as iron, nickel, and cobalt, magnetic oxides such as ferrite and magnetite and glass beads. The core material is preferably a magnetic material when it is used for the carrier in a magnetic brush method. The volume average particle diameter of the core material of the carrier is usually from 10 to 500 μm, preferably from 30 to 100 μm.

In order to coat the surface of the core material of the carrier with a resin, a method of coating the surface of the core material with a coating layer forming solution obtained by dissolving the above coating resin and, if necessary, various additives in a proper solvent can be employed. There is no particular limitation imposed on the solvent and an appropriate solvent may be selected as needed while taking the coating resin to be used, coating aptitude, or the like into account.

The carrier should generally have a suitable electrical resistance, and specifically, electrical resistance of from approximately $10^8$ to $10^{14}$ Ωcm is required. For example, when the carrier has, like an iron powder carrier, an electrical resistance as low as $10^6$ Ωcm, various problems may occur, including adhesion of the carrier to the image portion of the photoreceptor as a result of charge injection from a sleeve or loss of the latent image charge through the carrier, which may lead to distortions of the latent image or deficiency of the image. When the surface of the core material of the carrier is coated with a thick insulating resin, on the other hand, an excessive increase in the electrical resistance occurs and it prevents leakage of the carrier charge, which may lead to the occurrence of an edge effect, that is, the image density at the center portion of the image plane with a large surface area decreases extremely though the image is definite at the edges of the image plane. Accordingly, it is preferred to disperse a fine conductive powder in the resin coating layer in order to regulate the resistance of the carrier.

The carrier resistance is determined using a typical inter-electrode electrical resistance measurement method, wherein carrier particles are sandwiched between two polar plate electrodes, and the current at the time when a voltage is applied is measured. The resistance is evaluated under an electric field of $10^{3.8}$ V/cm.

The electrical resistance of the conductive powder itself is preferably $10^8$ Ωcm or less, more preferably $10^5$ Ωcm or less. Specific examples of the conductive powder include metals such as gold, silver, and copper, carbon black, simple conductive metal oxide systems such as titanium oxide and zinc oxide, and composite systems obtained by coating the surface of particles such as titanium oxide, zinc oxide, aluminum borate, potassium titanate or tin oxide particles with a conductive metal oxide. From the standpoint of production stability, cost, and low electrical resistance, carbon black is especially preferred. Although no particular limitation is imposed on the kind of carbon black, carbon blacks having good production stability and having a DBP (dioctyl phthalate) oil absorption amount within a range from 50 to 300 ml/100 g are preferred. The conductive powder having a volume average particle size not greater than 0.1 μm or less is preferred. For ensuring good dispersion, that having a volume average primary particle size not greater than 50 nm is preferred.

Examples of a method for forming the resin coating layer on the surface of the carrier core material include an immersion method in which a powder of the carrier core material is immersed in a coating layer forming solution, a spray method in which a coating layer forming solution is sprayed onto the surface of the carrier core material, a fluidized bed method in which a coating layer forming solution is atomized to the carrier core material while maintaining the material in a floating state by using an air flow, a kneader coater method in which the carrier core material and a coating layer forming solution are mixed in a kneader coater, followed by removal of the solvent, and a powder coating method in which the coating resin is converted into fine particles and then mixed with the carrier core material in a kneader coater at a melting point of the coating resin or greater, followed by cooling. Of these methods, the kneader coater method and powder coating method are especially preferred.

No particular limitation is imposed on the core material (carrier core material) usable for an electrostatic latent image developing carrier according to the present exemplary embodiment. Examples include magnetic metals such as iron, steel, nickel, and cobalt, magnetic oxides such as ferrite and magnetite, and glass beads. When the magnetic brush method is used, a magnetic carrier is preferred. In general, the average particle size of the carrier core material is preferably from 10 to 100 μm, more preferably from 20 to 80 μm.

In the two-component developer described above, a mixing ratio (weight ratio) of the electrostatic image developing toner of the present exemplary embodiment to the carrier is preferably from approximately 1:100 to 30:100 (toner:carrier), more preferably from 3:100 to 20:100 (toner:carrier).

<Preparation Process of Toner>

Examples of the preparation process of the toner according to the present exemplary embodiment include a kneading grinding process which includes kneading the above binder resin, the releasing agent, and the pigment having a complementary relationship with the color hue of the binder resin, grinding the kneaded mass, and classifying the ground product; a process including giving a mechanical impact or heat energy to the particles obtained by the kneading grinding process to change their shape; an emulsion polymerization aggregation process including mixing a dispersion obtained by emulsion polymerization of a polymerizable monomer(s) of the binder resin, a dispersion of the pigment having a complementary relationship with the color hue of the binder resin, and a dispersion of the releasing agent, aggregating the resulting mixture, and thermally fusing the aggregate to obtain toner particles; a suspension polymerization process including suspending a solution of a polymerizable monomer(s) for obtaining the binder resin, the pigment having a complementary relationship with the color hue of the binder resin, and the releasing agent in an aqueous solvent, and polymerizing the resulting solution; and a dissolution suspension process including suspending a solution of the binder resin, the pigment having a complementary relationship with the color hue of the binder resin, and the releasing agent in an aqueous solvent and grinding the resulting suspension. It is also possible to prepare a toner having a core/shell structure by using the toner obtained by the above process as a core, attaching aggregated particles to the toner, and thermally fusing the resulting toner.

In an invisible toner prepared using the kneading grinding process or dissolution suspension process, localization of the pigment is likely to occur and even after fixing, the localization cannot be eased. In the invisible toner prepared using the emulsion aggregation process, on the other hand, the pigment is dispersed uniformly and even after fixing, the pigment is uniformly dispersible.

The toner can be prepared, for example, in the following manner when the kneading grinding process is employed. Components such as the above binder resin, a colorant, and an infrared absorber are mixed, followed by melting and kneading. An apparatus for melting and kneading is, for example, a three-roll mill, a single screw kneader, a twin screw kneader, or a Banbury mixer. After the kneaded mass is ground coarsely, the coarse ground product is ground further with a grinder such as micronizer, ULMAX, jet-o-mizer, jet mill, krypton, or turbo mill and then, classified with a classifier such as elbow jet, MicroPlex, or DS separator to obtain a toner.

In the present exemplary embodiment, emulsion polymerization aggregation process capable of intentionally controlling the shape and surface structure of a toner is more preferred. The toner may be prepared by the emulsion polymerization aggregation process described in Japanese Patent No. 2547016 or JP-A-6-250439. The emulsion polymerization aggregation process enables to efficiently prepare a small-diameter toner in principle by using, as a starting substance, finely ground raw materials having usually a particle size of 1 μm or less. In accordance with this process, a toner is available by preparing a resin dispersion by using typically emulsion polymerization, separately preparing a colorant dispersion by dispersing a colorant in the same liquid, mixing the resin dispersion with the colorant dispersion, forming aggregated particles having a particle size corresponding to that of the toner, and heating to cause fusion and coalescence of the aggregated particles.

When the polyester resin is used as the binder resin, the following emulsifications step is performed in order to improve the compatibility between the crystalline polyester resin and the amorphous polyester resin.

—Emulsification Step—

In the emulsification step of the invention, at least one crystalline resin and at least one amorphous polyester resin are heated at a temperature ranging from a greater one of the melting point of the resin and the glass transition temperature of the resin to the boiling point of an organic solvent used for the emulsification to dissolve them into a uniform solution. To the resulting uniform solution is added an aqueous basic solution as a neutralizer. Then, the resulting solution is maintained at from pH 7 to pH9 while adding pure water thereto, and a shear stress is applied to the resulting mixture under stirring to reverse its phase into an O/W emulsion of the resin. The resulting emulsion is distilled under pressure to remove the solvent. In such a manner, a resin particle emulsion is obtained.

The pH after neutralization is from 7 to 9, preferably from 7 to 8. As the aqueous basic solution, an aqueous ammonium solution or a hydroxide of an alkali metal such as sodium hydroxide or potassium hydroxide maybe used. The pH less than 7 leads to the problem that coarse particles tend to appear in the emulsion. The pH exceeding 9 leads to the problem that the particle size of aggregated particles increases by the aggregation in the subsequent step.

By using particles in which the crystalline polyester resin and the amorphous polyester resin have been compatibilized in such a manner, the releasing agent particles tend to form aggregation with the resin particle portion having a lower acid value. As a result, a toner having the structure of the invention can be obtained.

<Emulsion Dispersion>

The above resin particles usually have an average particle size of 1 μm or less, preferably from 0.01 to 1 μm. When the average particle size exceeds 1 μm, the electrostatic image developing toner available in the end inevitably has a wide particle size distribution or free particles are generated in the toner, which tends to deteriorate the performance or reliability. The average particle size within the above range, on the other hand, is advantageous from the viewpoint of improvement in the performance and reliability, because the resulting toner is free from the above defects and the resin particles are dispersed uniformly in the toner because of a decrease in uneven distribution among toner particles. The above average particle size is measured using, for example, a Coulter Multisizer or laser scattering particle size analyzer.

As the dispersing medium for the dispersion, aqueous media and organic solvents are usable.

Examples of the aqueous media include water such as distilled water and ion exchanged water, alcohols, acetic esters, and ketones, and mixtures thereof. They may be used singly but used preferably in combination.

In the invention, a surfactant may be added to the above aqueous medium in advance. No particular limitation is imposed on the surfactant. Examples include anionic surfactants such as sulfate ester salts, sulfonate salts, phosphate esters, and soaps, cationic surfactants such as amine salts and quaternary ammonium salts, and nonionic surfactants such as polyethylene glycol, alkyl phenol ethylene oxide adducts, and polyhydric alcohols. Of these, the anionic surfactants and cationic surfactants are preferred. The nonionic surfactant is preferably used in combination with the anionic surfactant or cationic surfactant. The above surfactants may be used either singly or in combination.

Specific examples of the anionic surfactant include sodium dodecylbenzenesulfonate, sodium dodecyl sulfate, sodium alkylnaphthalenesulfonate, and sodium dialkylsulfosuccinate. Specific examples of the cationic surfactant include alkylbenzene dimethylammonium chloride, alkyltrimethylammonium chloride, and distearyl ammonium chloride. Of these, ion surfactants such as anionic surfactants and cationic surfactants are preferred.

As the organic solvent, ethyl acetate, methyl ethyl ketone, acetone, toluene or an alcohol such as isopropyl alcohol is used. It is selected as needed depending on the above binder resin.

When the resin particles are composed of a crystalline polyester resin and an amorphous polyester resin, they have self-water dispersibility owing to a functional group capable of becoming an anionic form through neutralization and thus can form a stable aqueous dispersion under action of an aqueous medium through neutralization of the entire or a part of the functional groups capable of becoming a hydrophilic group with a base. The functional group capable of becoming a hydrophilic group in the crystalline polyester resin and the amorphous polyester resin is an acidic group such as carboxyl group or sulfonic group so that examples of the neutralizer include inorganic bases such as sodium hydroxide, potassium hydroxide, lithium hydroxide, calcium hydroxide, sodium carbonate, and ammonia, and organic bases such as diethylamine, triethylamine, and isopropylamine.

When a polyester resin not dispersible in water by itself, that is, having no self-water dispersibility is used as the binder resin, it can be converted into particles having a particle size of 1 μm or less easily by dispersing, similar to the releasing agent which will be described later, the resin together with an ionic surfactant and a polyelectrolyte such as polymer acid or polymer base in a resin solution or an aqueous medium to be mixed therewith, heating the resulting dispersion to the melting point or greater, and treating it with a homogenizer or pressure discharge type disperser capable of applying a strong shearing stress. When the ionic surfactant or polyelectrolyte are used, its concentration in the aqueous medium should be adjusted to approximately from 0.5 to 5 mass %.

The amorphous polyester resin and the crystalline polyester resin may be blended with the releasing agent or may be blended after dissolved in an appropriate solvent. Alternatively, they may be blended by forming them into respective emulsions, mixing and aggregating them, and causing coalescence of the aggregate. In this melting and mixing, the toner is preferably prepared by the grinding process. When dissolving in a solvent is followed by blending, a toner preparation process by wet grinding together with the solvent and a dispersion stabilizer is preferred. When formation of respective emulsions is followed by mixing, although there is no particular limitation, a wet process of forming toner particles in water such as aggregation, suspension polymerization or dissolution suspension is preferred, because it enables to control the shape of the toner so as not to cause disruption of the toner in a developer. The aggregation coalescence process of emulsions facilitating shape control and formation of a resin coating layer is especially preferred for the toner preparation. It is preferred to prepare the toner by the aggregation coalescence process of emulsions in order to control the particle size or to form a surface coating layer.

Examples of an emulsifier to be used upon formation of emulsified particles include a homogenizer, a homomixer, Cavitron (trade name), Clearmix (trade name), a pressure kneader, an extruder, and a media dispersing machine.

<Image Forming Apparatus>

One example of the image forming apparatus according to the present exemplary embodiment will next be described.

FIG. 1 is a schematic view illustrating a structure example of the image forming apparatus for forming an image by using the image forming method according to the present exemplary embodiment. The image forming apparatus 200 illustrated in FIG. 1 is equipped with an image holding member 201, a charger 202, an image writing apparatus 203, a rotary developing device 204, a primary transfer roll 205, a cleaning blade 206, an intermediate transfer member 207, a plurality (three in this diagram) of supporting rolls 208, 209 and 210, and a secondary transfer roll 211.

The image holding member 201 has a drum-like shape as a whole and it has, on the outer peripheral surface (drum surface) thereof, a photosensitive layer. This image holding member 201 is mounted rotatably in the arrow C direction of FIG. 1. The charger 202 is for uniformly charging the image holding member 201. The image writing apparatus 203 is for irradiating an image light onto the image holding member 201 uniformly charged through the charger 202 and forming an electrostatic latent image.

The rotary developing device 204 has five developing units 204Y, 204M, 204C, 204K, and 204F that house therein a yellow color toner, a magenta color toner, a cyan color toner, a black color toner, and a toner for overcoat, respectively. In this apparatus, since toners are used as a developer for image formation, a yellow color toner, a magenta color toner, a cyan color toner, a black color toner, and an invisible toner for overcoat are housed in the developing units 204Y, 204M, 204C, 204K, and 204, respectively. In this rotarydeveloping device 204, the above five developing units 204Y, 204M, 204C, 204K, and 204F are rotated such that they are brought into contact with and face the image holding member 201 in the order of mention to transfer each toner to an electrostatic latent image corresponding to each color, thereby forming a visible toner image and an overcoat toner image.

Here, developing units other than the developing unit 204F may be removed from the rotary developing device 204, depending on a visible image required. For example, the rotary developing device may be one equipped with four developing units, that is, the developing unit 204Y, the developing unit 204M, the developing unit 204C, and the developing unit 204F. Alternatively, the developing units for forming visible images may be changed to those housing therein developers of a desired color, for example, red, blue or green.

The primary transfer roll 205 is for performing transfer (primary transfer) of a toner image (visible toner image or overcoat toner image) formed on the surface of the image holding member 201 to the outer peripheral surface of the intermediate transfer member 207 in the form an endless belt, while supporting the intermediate transfer member 207 between the primary transfer roll 205 and the image holding member 201. The cleaning blade 206 is for cleaning (removing) the toner left on the surface of the image holding member 201 after the image is transferred. The intermediate transfer member 207 is, at the inner peripheral surface thereof, stretched and hung by the plurality of supporting rolls 208, 209 and 210 and is supported rotatably in the arrow D direction and in the reverse direction. The secondary transfer roll 211 is for supporting, between the roll 211 and the supporting roll 210, recording paper (image output medium) to be carried in the arrow E direction by a paper carrying unit (not shown) and performing transfer (secondary transfer) of the toner image transferred to the outer peripheral surface of the intermediate transfer member 207 to the recording paper.

The image formation apparatus 200 forms toner images successively on the surface of the image holding member 201 and transfers the toner images, in an overlapped form, to the outer peripheral surface of the intermediate transfer member 207 and it works in the following manner. Described specifically, first, the image holding member 201 is rotated. After the surface of the image holding member 201 is charged uniformly by the charger 202, an image light is irradiated to the image holding member 201 from the image writing apparatus 203 to form an electrostatic latent image. This electrostatic latent image is developed by the yellow-color developing unit 204Y, and then the toner image is transferred to the outer peripheral surface of the intermediate transfer member 207 by the primary transfer roll 205. The yellow-color toner which has remained on the surface of the image holding member 201 without being transferred to the recording paper is cleaned by the cleaning blade 206. The intermediate transfer member 207 with the yellow-color toner image formed on the outer peripheral surface thereof is moved circularly once in a direction opposite to the direction of the arrow D while having the yellow-color toner image on the outer peripheral circuit. A magenta-color toner image is then superimposed on the yellow-color toner image and situated at a position to be transferred.

For each of the magenta, cyan and black colors, charging using the charger 202, the irradiation of an image light from the image writing apparatus 203, the formation of a toner image by using each of the developing units 204M, 204C and 204K, and the transfer of the toner image to the outer peripheral surface of the intermediate transfer member 207 are repeated successively, as in the above operation.

After completion of the transfer of four-color toner images to the outer peripheral surface of the intermediate transfer member 207, the surface of the image holding member 201 is charged uniformly by the charger 202 and then an image light is irradiated from the image writing apparatus 203 to form an electrostatic latent image. The resulting electrostatic latent image is developed using the developer 204F for overcoat and the resulting toner image is transferred to the outer peripheral surface of the intermediate transfer member 207 via the primary transfer roll 205. As a result, both a full-color image (visible toner image) in which four-color toner images have been overlapped on each other and an overcoat toner image are formed on the outer peripheral surface of the intermediate transfer member 207. These full-color visible toner image and overcoat toner image are transferred collectively to a recording paper by using the secondary transfer roll 211. Thus, a recording image having the full-color visible image and the overcoat image mixed therein can be obtained on the image formation surface of the recording paper.

In FIG. 1, it is preferred to heat and fix, after transfer of the toner images to the surface of the recording paper (one example of the image output media) through the secondary transfer roll 211, the toner images at a temperature range of from 140 to 210° C., preferably from 160 to 200° C.

<Image Forming Method>

The image forming method according to the present exemplary embodiment includes at least a step of charging an image holding member, a step of forming a latent image on the image holding member, a step of developing the latent image on the image holding member by using the above electrostatic image developer, a primary transfer step of transferring the developed toner image to an intermediate transfer member, a secondary transfer step of transferring the toner image transferred to the intermediate transfer member to a recording medium, and a step of fixing the toner image by using heat and pressure.

In each of the above steps, a known step in image formation methods can be employed.

As the latent image holding member, for example, an electrophotographic photoreceptor, dielectric recording body or the like is usable. When an electrophotographic receptor is used, the surface of the electrophotographic photoreceptor is uniformly charged using a corotron charger, contact charger or the like, followed by exposure to form an electrostatic latent image (latent image forming step). The photoreceptor is then brought into contact with or brought close to a developing roller having, on the surface thereof, a developer layer to attach toner particles to the electrostatic latent image, thereby forming a toner image on the electrophotographic photoreceptor (developing step). The toner image thus formed is transferred to the surface of an image receiving medium such as paper by utilizing a corotron charger or the like (transfer step). The toner image transferred to the surface of the image receiving medium is then thermally fixed using a fixing machine to form a final toner image.

During heat fixing using the above fixing unit, a releasing agent is usually supplied to the fixing member of the above fixing unit in order to prevent offset problems and the like.

No particular limitation is imposed on the method of supplying the releasing agent to the surface of a roller or belt serving as the fixing member used for heat fixing. Preferred examples of the method include a pad system using a pad impregnated with a liquid releasing agent, a web system, a roller system, and a non-contact shower system (spray system) Of these, a web system and a roller system are preferred. These systems are advantageous because they can supply the releasing agent uniformly and can easily control the supply amount of it. When a shower system is used, a blade or the like should be used in addition to ensure uniform supply of the releasing agent across the entire fixing member.

Image receiving media (recording materials) to which the toner images are to be transferred include, for example, a plain paper sheet or an OHP sheet used, for example, in an electrophotographic copier or a printer.

[Note]

(1) The electrostatic image developer according to the present exemplary embodiment contains a binder resin, a releasing agent, and a pigment having a complementary relationship with the color hue of the resin. The Lightness $\Delta L^*$ between the recording medium and toner image after the toner is fixed on the recording medium at a toner amount of 10 $g/m^2$ is 3.0 or less.

EXAMPLES

With regard to pigments such as copper phthalocyanine, cobalt blue, and cobalt aluminate, a copper or cobalt atom derived from these pigments can be analyzed using IPC (inductively coupled plasma) or atomic absorption and its content can be determined. According to the analysis, the charged amount and detection amount of a pigment have a relationship as shown in the following table.

TABLE 1

| Charged amount (ppm) | Detection amount (ppm) |
|---|---|
| 1 | 0.9 |
| 2 | 1.95 |
| 5 | 4.9 |

TABLE 1-continued

| Charged amount (ppm) | Detection amount (ppm) |
|---|---|
| 20 | 19.4 |
| 25 | 24.3 |

The present invention will next be described by Examples. It should however be borne in mind that the present invention is not limited to or by them. In Examples, all designations of "part" or "parts" and "%" mean part or parts by mass and % by mass, respectively, unless otherwise specifically indicated.

<Measurement Methods of Various Properties>

First, measurement method of physical properties of a toner and the like used in Examples and Comparative Examples will be described.

<Measurement Method of Particle Size and Particle Size Distribution of Toner>

In the invention, the particle size and particle size distribution of a toner are measured by using, as a measuring apparatus, "Multisizer II" (trade name, product of Beckman Coulter) and, as an electrolyte, "ISOTON-II" (trade name, product of Beckman Coulter)

In measurement, 0.5 to 50 mg of a test sample is added to 2 ml of a 5% aqueous solution of a surfactant, preferably sodium alkylbenzenesulfonate as a dispersant. The resulting mixture is added to 100 to 150 ml of the electrolyte. The electrolyte having the sample suspended therein is dispersed for about 1 minute by using an ultrasonic dispersing machine. The particle size distribution of the particles having a particle size from about 2 to 60 μm is measured by using an aperture having an aperture size of 100 μm in the "Multisizer II" and a volumge-average particle size is determined. The number of particles provided for measurement is 50000.

(Measurement Method of Weight-average Molecular Weight and Molecular Weight Distribution of Resin)

In the invention, the molecular weight of a binder resin and the like is measured under the following conditions. The GPC apparatus used is "HLC-8120 GPC, SC-8020" (trade name, product of Tosoh) equipped with two columns, "TSK gel SuperHM-H" (trade name, product of Tosoh, 6.0 mm ID×15 cm) and THF (tetrahydrofuran) is used as the eluent. The experiment is conducted under the following conditions: a sample concentration of 0.5%, a flow rate of 0.6 ml/min, a sample injection amount of 10 μl, and a measuring temperature of 40° C. An IR detector is used for measurement. The calibration curve is prepared using ten samples of "polystyrene standard sample: TSK Standards" (product of Tosoh): "A-500", "F-1", "F-10", "F-80", "F-380", "A-2500", "F-4", "F-40", "F-128", and "F-700".

(Volume Average Particle Size of Resin Fine Particles and Colorant Particles)

The volume average particle size of resin fine particles, colorant particles, or the like is measured using a laser diffraction particle size distribution analyzer ("LA-700", trade name; product of Horiba).

(Measurement Method of Glass Transition Temperature and Endothermic Peak Temperature of Resin)

The endothermic peak temperature of a crystalline polyester resin and a glass transition temperature (Tg) of an amorphous polyester resin can be determined in accordance with ASTM D3418 by using a differential scanning calorimeter ("DSC-60A", trade name; product of Shimadzu). In this apparatus (DSC-60A), temperature correction at the detection unit is conducted using the melting points of indium and zinc, and correction of the heat quantity is conducted using the heat of fusion of indium. The sample is placed in an aluminum pan, and using an empty pan as a control, measurement is conducted by raising the temperature at a heating rate of 10° C./min, holding the temperature at 200° C. for 5 minutes, cooling with liquid nitrogen from 200° C. to 0° C. at a cooling rate of −10° C./min, holding the temperature at 0° C. for 5 minutes, and then heating again from 0° C. to 200° C. at a heating rate of 10° C./min. Analysis is made from an endothermic curve at the second heating time. The onset temperature is taken as Tg of the amorphous polyester resin, while the maximum peak is taken as an endothermic peak temperature of the crystalline polyester resin.

(Measurement Method of Color difference ΔE*ab and Lightness L*)

After adjusting development parameters of "DCC400" (trade name; product of Fuji Xerox) and fixing an invisible toner for overcoat onto a recording medium at a toner amount of 10 g/m$^2$, a color difference ΔE*ab between a toner (for example, so-called invisible toner) image region and an exposed region of a recording medium after the toner is fixed onto the recording medium and the lightness L* of each region are measured using "Xrite 939" (trade name; product of Xrite). They are measured at 256 points and an average is shown in the evaluation results described later.

(Visual Organoleptic Evaluation on a Difference Felt between an Invisible Toner Image Region and an Exposed Region of a Recording Medium after a Toner is Fixed on the Recording Medium)

An organoleptic test by a panel of 10 experts including males and females is performed. In this test, development parameters of "DCC 400" (trade name; product of Fuji Xerox) are adjusted and after fixing of an invisible toner for overcoat onto a recording medium at a toner amount of 10 g/m$^2$, whether or not they feel a difference between the invisible toner image region and the exposed region of the recording medium after the toner is fixed on the recording medium is evaluated. The number of the experts who feel the difference, out of 10 experts, is shown. As the paper serving as the recording medium, "OK Top Coat+" (trade name; product of Oji Paper, basis weight: 127.9 g/m$^2$) is used. This paper has L* of 94.55 and a* of 0.98, and b* of −0.19.

(Visual Organoleptic Evaluation of Definition of Image Quality)

An organoleptic test by a panel of 10 experts including males and females is performed. In this test, development parameters of "DCC400" (trade name; product of Fuji Xerox) are adjusted and after fixing an invisible toner for overcoat on a recording medium at a toner amount of 10 g/m$^2$, definition of an image quality in the invisible toner image region after the toner is fixed onto the recording medium is evaluated. Among 10 experts, the number of experts who have felt that an overcoat image quality created by the toner used in following Examples is more definite than an overcoat image quality created by a toner not containing a pigment complementary to the hue of the toner is listed.

Example 1

| (Preparation of a binder resin) <Synthesis of amorphous polyester resin (A)> | |
|---|---|
| 2 Mol ethylene oxide adduct of bisphenol A: | 15 mol % |
| 2 Mol propylene oxide adduct of bisphenol A: | 35 mol % |
| Terephthalic acid: | 50 mol % |

A 5-L flask equipped with a stirrer, a nitrogen inlet, a temperature sensor, and a rectifying column was charged with the monomers at the above composition ratio. The temperature was increased to 190° C. for 1 hour. After confirmation that the reaction system was stirred uniformly, 1.0 mass % of titanium tetraethoxide was charged relative to 100 parts by mass of the resulting mixture of the three components. The temperature was raised to 240° C. from the above temperature for 6 hours while distilling off water thus generated. The dehydration condensation reaction was continued for further 2.5 hours at 240° C. to obtain an amorphous polyester resin (A) having a glass transition temperature of 63° C. and a weight average molecular weight (Mw) of 17000.

<Synthesis of Crystalline Polyester Resin (A)>

A crystalline polyester resin (A) was obtained by mixing 679.4 parts of succinic acid, 450.5 parts of butanediol, 40.6 parts of fumaric acid, and 2.5 parts of dibutyl tin in a flask, heating the resulting mixture to 240° C. in a reduced pressure atmosphere, and carrying out dehydration condensation for 6 hours. The weight average molecular weight (Mw) of the resulting cyrstalline polyester resin (A) was 14000 when measured by the above method. The endothermic peak temperature of the resulting crystalline polyester resin (A) was 91° C. when measured using a differential scanning calorimeter (DSC) by the above measurement method.

| (Preparation of Toner 1) | |
|---|---|
| Amorphous polyester resin (A) | 75.5 parts by mass |
| Crystalline polyester resin (A) | 20.5 parts by mass |
| Copper phthalocyanine pigment (product of Dainichiseika Color & Chemicals) | 1 ppm |
| Polyethylene wax ("Polywax 2000", trade name; product of Toyo Petrolite) | 4 parts by mass |

The above composition was mixed in powder form in a Henschel mixer. The resulting mixture was thermally kneaded in an extruder set at 100° C. After cooling, the kneaded mass was coarsely gound, finely ground, and classified to obtain mother toner particles having a volume average particle size D50 of 8.2 μm.

The resulting mother toner particles (100 parts by mass) and 0.7 part by mass of dimethylsilicone-oil-treated fine silica particles ("RY200", trade name; product of Nippon Aerosil) were mixed in a Henschel mixer to obtain Toner 1.

| <Preparation of Carrier> | |
|---|---|
| Ferrite particles (average particle size: 50 μm): | 100 parts by mass |
| Toluene: | 14 parts by mass |
| Styrene/methyl methacrylate copolymer (copolymerization ratio: 15/85) | 2 parts by mass |
| Carbon black: | 0.2 part by mass |

The above components except the ferrite particles were dispersed in a sand mill. The resulting dispersion and the ferrite particles were charged in a vacuum deaeration type kneader. The resulting mixture was stirred and dried under reduced pressure to obtain a carrier.

<Preparation of Developer>

The above carrier (100 parts by mass) was mixed with 5 parts by mass of Toner 1 to obtain Overcoat developer 1 of Example 1.

Examples 2, 3, 4 and 5

In a similar manner to Example 1 except that the content of the copper phthalocyanine pigment was changed to 5, 9, 15, and 20 ppm, respectively, Toners 2, 3, 4, and 5 were prepared and with 100 parts by mass of the above carrier, 5 parts by mass of Toners 2, 3, 4, and 5 were mixed to prepare Overcoat developers 2, 3, 4, and 5 of Examples 2, 3, 4, and 5, respectively.

Comparative Examples 1 and 2

In a similar manner to Example 1 except that the content of the copper phthalocyanine pigment was changed to 0 and 25 ppm, Toners 6 and 7 were prepared and with 100 parts by mass of the above carrier, 5 parts by mass of Toners 6 and 7 were mixed to obtain Overcoat developers 6 and 7 of Comparative Examples 1 and 2, respectively.

Examples 6, 7, 8, 9 and 10

In a similar manner to Example 1 except that the copper phthalocyanine pigment was changed to a cobalt aluminate (cobalt blue) pigment (product of Dainichiseika Color & Chemicals) and the content of the cobalt aluminate (cobalt blue) pigment was set at 1, 5, 9, 15, and 20 ppm, Toners 8, 9, 10, 11 and 12 were prepared, respectively, and with 100 parts by mass of the above carrier, 5 parts by mass of Toners 8, 9, 10, 11, and 12 were mixed to obtain Overcoat developers 8, 9, 10, 11, and 12 of Examples 6, 7, 8, 9, and 10, respectively.

Comparative Examples 3 and 4

In a similar manner to Example 1 except that the copper phthalocyanine pigment was changed to a cobalt aluminate (cobalt blue) pigment (product of Dainichiseika Color & Chemicals) and the content of the cobalt aluminate (cobalt blue) pigment was set at 0 and 25 ppm, Toners 13 and 14 were prepared, respectively, and with 100 parts by mass of the above carrier, 5 parts by mass of Toners 13 and 14 were mixed to obtain Overcoat developers 13 and 14 of Comparative Examples 3 and 4, respectively.

Examples 11, 12, 13, 14, and 15

| (Preparation of Toner 15) | |
|---|---|
| Amorphous polyester resin (A) | 87.5 parts by mass |
| Crystalline polyester resin (A) | 10.5 parts by mass |
| Copper phthalocyanine pigment (product of Dainichiseika Color & Chemicals) | 5 ppm |
| Polyethylene wax ("Polywax 2000", trade name; product of Toyo Petrolite) | 2 parts by mass |

The above composition was mixed in powder form in a Henschel mixer and the resulting mixture was thermally kneaded in an extruder set at 100° C. After cooling, the kneaded mass was coarsely ground, finely ground, and classified to obtain mother toner particles having a volume average particle size D50 of 8.2 μm.

The resulting mother toner particles (100 parts by mass) were mixed with 0.7 part by mass of dimethyl-silicone-oil treated fine silica particles ("RY200", trade name; product of Nippon Aerosil) in a Henschel mixer to obtain Toner 15 . With 100 parts by mass of the above carrier, 5 parts by mass of Toner 15 was mixed to obtain Overcoat developer 15 of Example 11.

In a similar manner to Example 11 except that the content of the copper phthalocyanine pigment was changed to 5, 9, 15, and 20 ppm, Toners 16, 17, 18, and 19 were prepared, respectively, and with 100 parts by mass of the above carrier, 5 parts by mass of Toners 16, 17, 18, and 19 were mixed to obtain Overcoat developers 16, 17, 18, and 19 of Examples 12, 13, 14, and 15, respectively.

Comparative Examples 5 and 6

In a similar manner to Example 11 except that the content of the copper phthalocyanine pigment was changed to 0 and 25 ppm, Toners 20 and 21 were prepared, respectively, and with 100 parts by mass of the above carrier, 5 parts by mass of Toners 20 and 21 were mixed to obtain Overcoat developers 20 and 21 of Comparative Examples 5 and 6, respectively.

Examples 16, 17, 18, 19, and 20

In a similar manner to Example 11 except that the copper phthalocyanine pigment was changed to a cobalt aluminate (cobalt blue) pigment (product of Dainichiseika Color & Chemicals) and the content of the cobalt aluminate (cobalt blue) pigment was set at 1, 5, 9, 15, and 20 ppm, Toners 22, 23, 24, 25 and 26 were prepared, respectively, and with 100 parts by mass of the above carrier, 5 parts by mass of Toners 22, 23, 24, 25, and 26 were mixed to obtain Overcoat developers 22, 23, 24, 25, and 26 of Examples 16, 17, 18, 19, and 20, respectively.

Comparative Examples 7 and 8

In a similar manner to Example 11 except that the copper phthalocyanine pigment was changed to a cobalt aluminate (cobalt blue) pigment (product of Dainichiseika Color & Chemicals) and the content of the cobalt aluminate (cobalt blue) pigment was set at 0 and 25 ppm, Toners 27 and 28 were prepared, respectively, and with 100 parts by mass of the above carrier, 5 parts by mass of Toners 27 and 28 were mixed to obtain Overcoat developers 27 and 28 of Comparative Examples 7 and 8 , respectively.

Examples 21, 22, 23, 24, and 25

| (Preparation of Toner 29) | |
|---|---|
| Amorphous polyester resin (A) | 90.0 parts by mass |
| Crystalline polyester resin (A) | 8.0 parts by mass |
| Copper phthalocyanine pigment (product of Dainichiseika Color & Chemicals) | 5 ppm |
| Polyethylene wax ("Polywax 2000", trade name; product of Toyo Petrolite) | 2 parts by mass |

The above composition was mixed in powder form in a Henschel mixer and the resulting mixture was thermally kneaded in an extruder set at 100° C. After cooling, the resulting kneaded mass was coarsely ground, finely ground, and classified to obtain mother toner particles having a volume average particle size D50 of 8.2 μm.

The mother toner particles (100 parts by mass) thus obtained and 0.7 part by mass of dimethylsilicone-oil treated fine silica particles ("RY200", trade name; product of Nippon Aerosil) were mixed in a Henschel mixer to obtain Toner 29. With 100 parts by mass of the above carrier, 5 parts by mass of Toner 29 was mixed to obtain Overcoat developer 29 of Example 21.

In a similar manner to Example 21 except the content of the copper phthalocyanine pigment was changed to 5, 9, 15, and 20 ppm, Toners 30, 31, 32, and 33 were prepared, respectively. With 100 parts by mass of the above carrier, 5 parts by mass of Toners 30, 31, 32, and 33 were mixed to obtain Overcoat developers 30, 31, 32, and 33 of Examples 22, 23, 24, and 25, respectively.

Comparative Examples 9 and 10

In a similar manner to Example 21 except that the content of the copper phthalocyanine pigment was changed to 0 and 25 ppm, Toners 34 and 35 were prepared, respectively. With 100 parts by mass of the above carrier, 5 parts by mass of Toners 34 and 35 were mixed to obtain Overcoat developers 34 and 35 of Comparative Examples 9 and 10, respectively.

Examples 26, 27, 28, 29, and 30

In a similar manner to Example 21 except that the copper phthalocyanine pigment was changed to a cobalt aluminate (cobalt blue) pigment (product of Dainichiseika Color & Chemicals) and the content of the cobalt aluminate (cobalt blue) pigment was set at 1, 5, 9, 15, and 20 ppm, Toners 36, 37, 38, 39 and 40 were prepared, respectively. With 100 parts by mass of the above carrier, 5 parts by mass of Toners 36, 37, 38, 39, and 40 were mixed to obtain Overcoat developers 36, 37, 38, 39, and 40 of Examples 26, 27, 28, 29, and 30, respectively.

Comparative Examples 11 and 12

In a similar manner to Example 21 except that the copper phthalocyanine pigment was changed to a cobalt aluminate (cobalt blue) pigment (product of Dainichiseika Color & Chemicals) and the content of the cobalt aluminate (cobalt blue) pigment was set at 0 and 25 ppm, Toners 41 and 42 were prepared, respectively. With 100 parts by mass of the above carrier, 5 parts by mass of Toners 41 and 42 were mixed to obtain Overcoat developers 41 and 42 of Comparative Examples 11 and 12, respectively.

Examples 31, 32, 33, 34, and 35 mass of Toners 44, 45, 46, and 47 were mixed to obtain Overcoat developers 44, 45, 46, and 47 of Examples 32, 33, 34, and 35, respectively.

Comparative Examples 13 and 14

In a similar manner to Example 31 except that the content of the copper phthalocyanine pigment was changed to 0 and 25 ppm, Toners 48 and 49 were prepared, respectively. With 100 parts by mass of the above carrier, 5 parts by mass of Toners 48 and 49 were mixed to obtain Overcoat developers 48 and 49 of Comparative Examples 13 and 14, respectively.

Examples 36, 37, 38, 39, and 40

In a similar manner to Example 31 except that the copper phthalocyanine pigment was changed to a cobalt aluminate (cobalt blue) pigment (product of Dainichiseika Color & Chemicals) and the content of the cobalt aluminate (cobalt blue) pigment was set at 1, 5, 9, 15, and 20 ppm, Toners 50, 51, 52, 53 and 54 were prepared, respectively. With 100 parts by mass of the above carrier, 5 parts by mass of Toners 50, 51, 52, 53, and 54 were mixed to obtain Overcoat developers 50, 51, 52, 53, and 54 of Examples 36, 37, 38, 39, and 40, respectively.

Comparative Examples 15 and 16

In a similar manner to Example 31 except that the copper phthalocyanine pigment was changed to a cobalt aluminate (cobalt blue) pigment (product of Dainichiseika Color & Chemicals) and the content of the cobalt aluminate (cobalt blue) pigment was set at 0 and 25 ppm, Toners 55 and 56 were prepared, respectively. With 100 parts by mass of the above carrier, 5 parts by mass of Toners 55 and 56 were mixed to obtain Overcoat developers 55 and 56 of Comparative Examples 15 and 16, respectively.

Examples 41, 42, 43, 44, and 45

| (Preparation of Toner 43) | |
|---|---|
| Amorphous polyester resin (A) | 97.0 parts by mass |
| Crystalline polyester resin (A) | 1.0 part by mass |
| Copper phthalocyanine pigment (product of Dainichiseika Color & Chemicals) | 5 ppm |
| Polyethylene wax ("Polywax 2000", trade name; product of Toyo Petrolite) | 2 parts by mass |

The above composition was mixed in powder form in a Henschel mixer and the resulting mixture was thermally kneaded in an extruder set at 100° C. After cooling, the resulting kneaded mass was coarsely ground, finely ground, and classified to obtain mother toner particles having a volume average particle size D50 of 8.2 μm.

The resulting mother toner particles (100 parts by mass) and 0.7 part by mass of dimethylsilicone-oil treated fine silica particles ("RY200", trade name; product of Nippon Aerosil) were mixed in a Henschel mixer to obtain Toner 43. With 100 parts by mass of the above carrier, 5 parts by mass of Toner 43 was mixed to obtain Overcoat developer 43 of Example 31.

In a similar manner to Example 31 except the content of the copper phthalocyanine pigment was changed to 5, 9, 15, and 20 ppm, Toners 44, 45, 46, and 47 were prepared, respectively. With 100 parts by mass of the above carrier, 5 parts by

| (Preparation of Toner 57) | |
|---|---|
| Amorphous polyester resin (A) | 98.0 parts by mass |
| Crystalline polyester resin (A) | 1.0 part by mass |
| Copper phthalocyanine pigment (product of Dainichiseika Color & Chemicals) | 4 ppm |
| Polyethylene wax ("Polywax 2000", trade name; product of Toyo Petrolite) | 1 part by mass |

The above composition was mixed in powder form in a Henschel mixer and the resulting mixture was thermally kneaded in an extruder set at 100° C. After cooling, the resulting kneaded mass was coarsely ground, finely ground, and classified to obtain mother toner particles having a volume average particle size D50 of 8.2 μm.

The resulting mother toner particles (100 parts by mass) and 0.7 part by mass of dimethylsilicone-oil treated fine silica particles ("RY200", trade name; product of Nippon Aerosil) were mixed in a Henschel mixer to obtain Toner 57. With 100 parts by mass of the above carrier, 5 parts by mass of Toner 57 was mixed to obtain Overcoat developer 57 of Example 41.

In a similar manner to Example 41 except the content of the copper phthalocyanine pigment was changed to 5, 9, 15, and 20 ppm, Toners 58, 59, 60, and 61 were prepared, respectively. With 100 parts by mass of the above carrier, 5 parts by mass of Toners 58, 59, 60, and 61 were mixed to obtain Overcoat developers 58, 59, 60, and 61 of Examples 42, 43, 44, and 45, respectively.

Comparative Examples 17 and 18

In a similar manner to Example 41 except that the content of the copper phthalocyanine pigment was changed to 0 and 25 ppm, Toners 62 and 63 were prepared, respectively. With 100 parts by mass of the above carrier, 5 parts by mass of Toners 62 and 63 were mixed to obtain Overcoat developers 62 and 63 of Comparative Examples 17 and 18, respectively.

Examples 46, 47, 48, 49, and 50

In a similar manner to Example 41 except that the copper phthalocyanine pigment was changed to a cobalt aluminate (cobalt blue) pigment (product of Dainichiseika Color & Chemicals) and the content of the cobalt aluminate (cobalt blue) pigment was set at 1, 5, 9, 15, and 20 ppm, Toners 64, 65, 66, 67 and 68 were prepared, respectively. With 100 parts by mass of the above carrier, 5 parts by mass of Toners 64, 65, 66, 67, and 68 were mixed to obtain Overcoat developers 64, 65, 66, 67, and 68 of Examples 46, 47, 48, 49, and 50, respectively.

Comparative Examples 19 and 20

In a similar manner to Example 41 except that the copper phthalocyanine pigment was changed to a cobalt aluminate (cobalt blue) pigment (product of Dainichiseika Color & Chemicals) and the content of the cobalt aluminate (cobalt blue) pigment was set at 0 and 25 ppm, Toners 69 and 70 were prepared, respectively. With 100 parts by mass of the above carrier, 5 parts by mass of Toners 69 and 70 were mixed to obtain Overcoat developers 69 and 70 of Comparative Examples 19 and 20, respectively.

Example 51

Preparation of Styrene Acrylic Resin by Kneading and Grinding (Synthesis Process of Styrene Acrylic Resin)

A reaction vessel equipped with a stirrer and a thermometer was charged with 160 parts by mass of deionized water, 0.04 part by mass of an aqueous sodium polyacrylate solution (solid content: 3.3 mass %), 0.01 part by mass of a solution obtained by dissolving, in 550 parts by weight of ion exchanged water, 6 parts by weight of a nonionic surfactant ("Nonipole 400", trade name; product of Sanyo Chemical) and 10 parts by weight of an anionic surfactant ("Neogen SC", trade name; product of Dauichi Kougyo Seiyaku), and 0.4 part by mass of sodium sulfate. Then, 80 parts by mass of styrene, 20 parts by mass of butyl acrylate, and 0.3 part by mass of trimethylolpropane triacrylate as monomer components, and 2 parts by mass of benzoyl peroxide and 0.5 part by mass of t-butylperoxy-2-ethylhexyl monocarbonate as polymerization initiators were added. The temperature was raised from 40° C. to 130° C. for 65 minutes while stirring the content. After the temperature reached 130° C., stirring was performed for further 2.5 hours and the reaction mixture was cooled to obtain a suspension of polymer particles. The polymer was separated, washed, and dried to obtain Styrene acrylic resin (51).

| (Preparation of toner) | |
|---|---|
| Styrene acrylic resin (51) | 96 parts by mass |
| Copper phthalocyanine pigment (product of Dainichiseika Color & Chemicals) | 1 ppm |
| Polyethylene wax ("Polywax 2000", trade name; product of Toyo Petrolite) | 4 parts by mass |

The above composition was mixed in powder form in a Henschel mixer. The resulting mixture was thermally kneaded in an extruder set at 100° C. After cooling, the kneaded mass was coarsely gound, finely ground, and classified to obtain mother toner particles having a volume average particle size DSO of 8.1 μm.

The resulting mother toner particles (100 parts by mass) and 0.7 part by mass of dimethylsilicone-oil-treated fine silica particles ("RY200", trade name; product of Nippon Aerosil) were mixed in a Henschel mixer to prepare Toner 51.

| <Preparation of Carrier> | |
|---|---|
| Ferrite particles (average particle size: 50 μm): | 100 parts by mass |
| Toluene: | 14 parts by mass |
| Styrene/methyl methacrylate copolymer (copolymerization ratio: 15/85) | 2 parts by mass |
| Carbon black: | 0.2 part by mass |

The above components except the ferrite particles were dispersed in a sand mill. The resulting dispersion and the ferrite particles were charged in a vacuum deaeration type kneader. The resulting mixture was stirred and dried under reduced pressure to obtain a carrier.

<Preparation of Developer>

With 100 parts by mass of the above carrier, 5 parts by mass of Toner 51 was mixed to obtain Overcoat developer 51 of Example 51.

Examples 52, 53, 54 and 55

In a similar manner to Example 51 except that the content of the pigment in Developer 51 was changed to 5, 9, 15 , and 20 ppm, Developers 52, 53, 54, and 55 of Examples 52, 53, 54, and 55 were prepared, respectively.

Comparative Examples 51 and 52

In a similar manner to Example 51 except the content of the pigment in Developer 51 was changed to 0 and 25 ppm, Developers 57 and 58 of Comparative Examples 51 and 52 were prepared, respectively.

Example 61

| Preparation process of toner using aggregation and coalescence of polyester emulsion (Preparation of Polyester resin dispersion (1) not containing a crosslinking component) | |
|---|---|
| Resin 10: polyester not containing a crosslinking component (polyester obtained by condensing, in the presence of titanium tetraethoxide as a catalyst, a material having as acid monomers 30 mol % of terephthalic acid and 70 mol % of fumaric acid and as alcohol monomers 5 mol % of an ethylene oxide adduct of bisphenol A and 95 mol % of a propylene oxide adduct of bisphenol A. Mw: 18,000, acid value: 15 mgKOH/g) | 100 parts |
| Solvent 1: ethyl acetate | 40 parts |

-continued

| Preparation process of toner using aggregation and coalescence of polyester emulsion (Preparation of Polyester resin dispersion (1) not containing a crosslinking component) | |
|---|---|
| Solvent 2: 2-butanol | 25 parts |
| Alkali: 10 wt. % aqueous ammonia (amount corresponding to 3 times, in terms of a molar ratio, the acid value of the resin) | |
| Distilled water: | 400 parts |

After 100 parts of Resin 10 was charged in a temperature-controllable and nitrogen-replaceable vessel, it was dissolved in a mixture of 40 parts of Solvent 1 and 25 parts of Solvent 2. Then, an alkali was added in an amount corresponding to 3 times, in terms of molar ratio, the acid value of the resin, followed by stirring for 30 minutes.

The vessel was then purged with dry nitrogen and the temperature was set at 40° C. Emulsification was conducted by adding dropwise 400 parts of distilled water at a rate of 2 parts/min while stirring.

After completion of the dropwise addition, the resulting emulsion was returned to room temperature and then, bubbled with dry nitrogen for 48 hours while stirring in order to reduce the content of Solvent 1 and Solvent 2 to 1000 ppm or less. Resin dispersion (1) was prepared in such a manner.

| (Preparation of Polyester resin dispersion (2) containing a crosslinking component) | |
|---|---|
| Resin 11: polyester containing trimellitic acid as a crosslinking component (polyester obtained by condensing, in the presence of titanium tetraethoxide as a catalyst, a material having as acid monomers 60 mol % of terephthalic acid, 25 mol % of fumaric acid, and 5 mol % of trimellitic acid and as alcohol monomers 50 mol % of an ethylene oxide adduct of bisphenol A and 50 mol % of a propylene oxide adduct of bisphenol A. Mw: 38,000, acid value: 15 mgKOH/g) | 100 parts |
| Solvent 1: ethyl acetate | 40 parts |
| Solvent 2: 2-butanol | 25 parts |
| Alkali: 10 wt. % aqueous ammonia (amount corresponding to 3 times, in terms of a molar ratio, the acid value of the resin) | |
| Distilled water: | 400 parts |

After 100 parts of Resin 11 was charged in a temperature-controllable and nitrogen-substitutable vessel, it was dissolved in a mixture of 40 parts of Solvent 1 and 25 parts of Solvent 2. Then, an alkali was added in an amount corresponding to 3 times, in terms of molar ratio, the acid value of the resin, followed by stirring for 30 minutes.

The vessel was then purged with dry nitrogen and the temperature was set at 40° C. The resulting mixture was emulsified by adding dropwise 400 parts of distilled water at a rate of 2 parts/min while stirring.

After completion of the dropwise addition, the resulting emulsion was returned to room temperature and then, bubbled with dry nitrogen for 48 hours while stirring in order to reduce the content of Solvent 1 and Solvent 2 to 1000 ppm or less. Resin dispersion (2) was prepared in such a manner.

| (Preparation of crystalline polyester resin dispersion (3)) | |
|---|---|
| Resin 12: crystalline polyester resin | 100 parts |

(crystalline resin obtained by charging the following monomers except trimellitic anhydride: 75 mol parts of terephthalic acid, 23 mol parts of dodecenyl succinic anhydride, 2 mol parts of trimellitic anhydride, 50 mol parts of a propylene oxide adduct of bisphenol A, and 50 mol parts of a 2 mol ethylene oxide adduct of bisphenol A, adding 0.20 part of titanium tetraethoxide relative to 100 parts of the resulting mixture, reacting the resulting mixture at 220° C. in a nitrogen atmosphere until the softening point became 110° C., reducing the temperature to 190° C., adding 2 mol % of trimellitic anhydride in portions, continuing the reaction for 1.5 hours at the same temperature, and then cooling the reaction mixture. Weight average molecular weight: 33000. acid value: 15.5)

| | |
|---|---|
| Solvent 1: ethyl acetate | 40 parts |
| Solvent 2: 2-butanol | 25 parts |
| Alkali: 10 wt. % aqueous ammonia (amount corresponding to 3 times, in terms of a molar ratio, the acid value of the resin) | |
| Distilled water: | 400 parts |

After 100 parts of Resin 12 was charged in a temperature-controllable and nitrogen-replaceable and was dissolved in a mixture of 40 parts of Solvent 1 and 25 parts of Solvent 2 , while keeping the temperature at 60° C., an alkali was added in an amount corresponding to 3 times, in terms of a molar ratio, the acid value of the resin, followed by stirring for 30 minutes.

The vessel was then purged with dry nitrogen and the temperature was set at 60° C. The resulting mixture was emulsified by adding dropwise 400 parts of distilled water at a rate of 2 parts/min while stirring.

After completion of the dropwise addition, the resulting emulsion was returned to room temperature and then, bubbled with dry nitrogen for 48 hours while stirring in order to reduce the content of Solvent 1 and Solvent 2 to 1000 ppm or less. Resin dispersion (3) was prepared in such a manner.

| (Preparation of blue pigment dispersion (1)) | |
|---|---|
| Copper phthalocyanine pigment (product of Dainichiseika Color & Chemicals) | 70 parts |
| Nonionic surfactant ("Nonipole 400", trade name; product of Sanyo Chemical) | 5 parts |
| Ion exchanged water | 200 parts |

The above components were mixed and dissolved. The resulting solution was dispersed for 10 minutes in a homogenizer ("ULTRA TURRAX T50", trade name; product of IKA). Ion exchanged water was then added to the dispersion to give a solid concentration of 10% to prepare Blue pigment dispersion (1) having, dispersed therein, colorant particles having an average particle size of 190 nm.

| (Preparation of releasing agent particle dispersion (1)) | |
|---|---|
| Paraffin wax ("HNP-9", trade name; product of Nippon Seiro) | 100 parts |
| Anionic surfactant ("Lipal 860K", trade name; product of Lion) | 10 parts |
| Ion exchanged water | 390 parts |

After the above components were mixed and dissolved, the resulting solution was dispersed in a homogenizer ("ULTRA TURRAX", trade name; product of IKA) and subjected to dispersion treatment in a pressure discharge type homogenizer to prepare Releasing agent particle dispersion (1) having, dispersed therein, releasing agent particles (paraffin wax) having an average particle size of 220 nm.

| (Preparation process of mother toner particles) | |
|---|---|
| Resin dispersion (1) | 150 parts |
| Resin dispersion (2) | 150 parts |
| Resin dispersion (3) | 70 parts |
| Blue pigment dispersion (1) | 1 ppm |
| Releasing agent dispersion (1) | 80 parts |
| Cationic surfactant ("Sanisol B50" trade name, product of Kao) | 1.5 parts |

The above components were charged in a round-type stainless flask. The mixture was adjusted to pH 3.5 with 0.1N sulfuric acid. Then, 30 parts of an aqueous nitric acid solution containing 10 wt. % of polyaluminum chloride was added as a flocculant. The resulting mixture was dispersed at 30° C. by using a homogenizer ("ULTRA TURRAX T50", trade name; product of IKA), followed by heating to 45° C. in a heating oil bath. After the resulting particle dispersion was maintained at 45° C. for 30 minutes, a mixture of 150 parts of Resin dispersion (1) and 150 parts of Resin dispersion (2) was added in portions. After the reaction mixture was maintained for 1 hour, 0.1N sodium hydroxide was added to adjust its pH to 8.5. The mixture was heated to 85° C. while continuing stirring and maintained for 5 hours. Then, the resulting mixture was cooled to 20° C. at a cooling rate of 20° C./min. The cooling was followed by filtration, sufficient washing with ion exchanged water, and drying to obtain Mother toner particles (61) as cyan mother toner particles.

The resulting mother toner particles (100 parts by mass) and 0.7 part by mass of dimethylsilicone-oil treated fine silica particles ("RY200", trade name; product of Nippon Aerosil) were mixed in a Henschel mixer to obtain Toner 61.

| <Preparation of Carrier> | |
|---|---|
| Ferrite particles (average particle size: 50 μm): | 100 parts by mass |
| Toluene: | 14 parts by mass |
| Styrene/methyl methacrylate copolymer (copolymerization ratio: 15/85) | 2 parts by mass |
| Carbon black: | 0.2 part by mass |

The above components except the ferrite particles were dispersed in a sand mill. The resulting dispersion and the ferrite particles were charged in a vacuum deaeration type kneader. The resulting mixture was stirred and dried under reduced pressure to obtain a carrier.

<Preparation of Developer>

With 100 parts by mass of the above carrier was mixed 5 parts by mass of Toner 61 to obtain Overcoat developer 61 of Example 61.

Examples 62, 63, 64 and 65

In a similar manner to Example 61 except that the content of the pigment in Developer 61 was changed to 5, 9, 15, and 20 ppm, Developers 62, 63, 64 and 65 of Examples 62, 63, 64, and 65 were obtained, respectively.

Comparative Examples 61 and 62

In a similar manner to Example 61 except that the content of the pigment in Developer 61 was changed to 0 and 25 ppm, Developers 67 and 68 of Comparative Examples 61 and 62 were obtained, respectively.

Example 71

Preparation of Styrene Acrylic Resin by Emulsion Polymerization/Aggregation and Coalescence

| (Preparation of resin dispersion (70)) | |
|---|---|
| Styrene | 316 parts |
| n-Butyl acrylate | 84 parts |
| Acrylic acid | 6 parts |
| Dodecane thiol | 6 parts |
| Carbon tetrabromide | 4 parts |

The above components were mixed and dissolved. In a flask, the resulting solution was emulsion-dispersed in a solution obtained by dissolving 6 parts of a nonionic surfactant ("Nonipole 400", trade name; product of Sanyo Chemical) and 10 parts of an anionic surfactant ("Neogen SC", trade name; product of Daiichi Kogyo Seiyaku) in 560 parts of ion exchanged water. While mixing the resulting dispersion for 20 minutes slowly, 50 parts of ion exchanged water having 4 parts of ammonium persulfate dissolved therein was charged. After purging with nitrogen, the content was heated to 83° C. in an oil bath while stirring in the flask. Emulsion polymerization was continued as was for 7 hours. Ion exchanged water was added so that a solid concentration in the dispersion became 10%. As a result, Resin dispersion (4) having, dispersed therein, resin particles having an average particle size of 220 nm, a glass transition temperature (Tg) of 54.3° C. and a weight average molecular weight of 32300 was obtained.

| (Preparation of Blue pigment dispersion (1)) | |
|---|---|
| Copper phthalocyanine pigment (product of Dainichiseika Color & Chemicals) | 70 parts |
| Nonionic surfactant ("Nonipole 400", trade name; product of Sanyo Chemical) | 5 parts |
| Ion exchanged water | 200 parts |

The above components were mixed and dissolved. The resulting solution was dispersed for 10 minutes in a homogenizer ("ULTRA TURRAX T50", trade name; product of IKA). Ion exchanged water was then added to the dispersion to give a solid concentration of 10% to prepare Blue pigment dispersion (1) having, dispersed therein, colorant particles having an average particle size of 190 nm.

| (Preparation of releasing agent particle dispersion (1)) | |
|---|---|
| Paraffin wax ("HNP-9", trade name; product of Nippon Seiro) | 100 parts |
| Anionic surfactant ("Lipal 860K", trade name; product of Lion) | 10 parts |
| Ion exchanged water | 390 parts |

After the above components were mixed and dissolved, the resulting solution was dispersed in a homogenizer ("ULTRA TURRAX", product of IKA) and was subjected to dispersion treatment in a pressure discharge type homogenizer to prepare Releasing agent particle dispersion (1) having, dispersed therein, releasing agent particles (paraffin wax) having an average particle size of 220 nm.

| (Preparation process of mother toner particles) | |
|---|---|
| Resin dispersion (70) | 320 parts |
| Blue pigment dispersion (1) | 1 ppm |
| Releasing agent particle dispersion (1) | 96 parts |
| Aluminum sulfate (product of Wako Pure Chemical) | 1.5 parts |
| Ion exchanged water | 1270 parts |

The above components were charged in a round flask made of stainless and equipped with a temperature-controlling jacket. After the resulting mixture was dispersed at 5000 rpm for 5 minutes by using a homogenizer ("TULTRA TURRUX T50", trade name; product of IKA), the flask was moved. The resulting dispersion was allowed to stand while stirring with four paddles at 25° C. for 20 minutes. Then, the flask was heated with a mantle heater while stirring and heating was continued at a heating rate of 1° C./min until the inside temperature of the flask became 48° C. The reaction mixture was maintained at 48° C. for 20 minutes. Additional 80 parts of the resin particle dispersion was then added in portions. After the reaction mixture was maintained at 48° C. for 30 minutes, a 1N aqueous sodium hydroxide solution was added to adjust its pH to 6.5.

Then, the temperature was raised to 95° C. at a heating rate of 1° C./min and the reaction mixture was maintained at the temperature for 30 minutes. A 0.1N aqueous nitric acid solution was added to the reaction mixture to adjust its pH to 4.8 and then the mixture was allowed to stand at 95° C. for 2 hours. The 1N aqueous sodium hydroxide solution was added further to adjust its pH to 6.5 and then, the reaction mixture was allowed to stand for 5 hours at 95° C. Then, the mixture was cooled to 30° C. at a cooling rate of 5° C./min.

The toner particle dispersion thus obtained was then filtered. (A) 2000 parts of ion exchanged water of 35° C. was added to the toner particles thus obtained, (B) the mixture was left to stand for 20 minutes while stirring, and (C) and then, the reaction mixture was filtered. The operation from (A) to (C) was repeated five times and then, the toner particles on the filter paper were transferred to a vacuum drier. They were dried for 10 hours at 45° C. and 1,000 Pa or less to obtain Mother toner particles (71).

The mother toner particles thus obtained (100 parts by mass) and 0.7 part by mass of dimethylsilicone-oil treated fine silica particles ("RY200", trade name; product of Nippon Aerosil) were mixed in a Henschel mixer to obtain Toner 71.

(Preparation of Carrier)

| | |
|---|---|
| Ferrite particles (average particle size: 50 μm): | 100 parts by mass |
| Toluene: | 14 parts by mass |
| Styrene/methyl methacrylate copolymer (copolymerization ratio: 15/85) | 2 parts by mass |
| Carbon black: | 0.2 part by mass |

The above components except the ferrite particles were dispersed in a sand mill. The resulting dispersion and the ferrite particles were charged in a vacuum deaeration type kneader. The resulting mixture was stirred and dried under reduced pressure to obtain a carrier.

<Preparation of Developer>

With 100 parts by mass of the above carrier, 5 parts by mass of Toner 71 was mixed to obtain Overcoat developer 71 for Example 71.

Examples 72, 73, 74, and 75

In a similar manner to Example 71 except that the pigment content in Developer 71 was changed to 5, 9, 15, and 20 ppm, Developers 72, 73, 74, and 75 of Examples 72, 73, 74, and 75 were obtained, respectively.

Comparative Examples 71 and 72

In a similar manner to Example 71 except that the pigment content in Developer 71 was changed to 0 and 25 ppm, Developers 77 and 78 of Comparative Examples 71 and 72 were obtained, respectively.

Organoleptic evaluation results of the developers obtained using the aggregation and coalescence process are a little superior to those of the developers obtained using the kneading and grinding process, presumably because the pigments become uniform due to good dispersibility, leading to achievement of a natural image quality.

TABLE 2

| | L* of paper | L* of toner image | Pigment having a complementary relationship: Copper phthalocyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 1 | 94.55 | 96 | 1 | — | 2.4 | 0 | 8 |
| Ex. 2 | 94.55 | 96 | 5 | — | 1.9 | 0 | 8 |
| Ex. 3 | 94.55 | 96 | 9 | — | 1.3 | 1 | 9 |
| Ex. 4 | 94.55 | 96 | 15 | — | 3.5 | 1 | 9 |
| Ex. 5 | 94.55 | 96 | 20 | — | 5.5 | 3 | 9 |
| Comp. Ex. 1 | 94.55 | 96 | 0 | — | 6.2 | 5 | 4 |
| Comp. Ex. 2 | 94.55 | 96 | 25 | — | 7.5 | 7 | 6 |
| Ex. 6 | 94.55 | 96 | — | 1 | 2.3 | 0 | 7 |
| Ex. 7 | 94.55 | 96 | — | 5 | 1.8 | 0 | 6 |
| Ex. 8 | 94.55 | 96 | — | 9 | 1.3 | 1 | 7 |
| Ex. 9 | 94.55 | 96 | — | 15 | 3.6 | 1 | 7 |
| Ex. 10 | 94.55 | 96 | — | 20 | 5.9 | 4 | 8 |
| Comp. Ex. 3 | 94.55 | 96 | — | 0 | 7.3 | 5 | 5 |
| Comp. Ex. 4 | 94.55 | 96 | — | 25 | 10.2 | 9 | 6 |

TABLE 3

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 11 | 94.55 | 94 | 1 | — | 2.6 | 0 | 8 |
| Ex. 12 | 94.55 | 94 | 5 | — | 2.1 | 0 | 9 |
| Ex. 13 | 94.55 | 94 | 9 | — | 2.3 | 1 | 9 |
| Ex. 14 | 94.55 | 94 | 15 | — | 3.3 | 1 | 8 |
| Ex. 15 | 94.55 | 94 | 20 | — | 5.3 | 3 | 9 |
| Comp. Ex. 5 | 94.55 | 94 | 0 | — | 6.2 | 4 | 5 |
| Comp. Ex. 6 | 94.55 | 94 | 25 | — | 6.9 | 7 | 6 |
| Ex. 16 | 94.55 | 94 | — | 1 | 2.6 | 0 | 7 |
| Ex. 17 | 94.55 | 94 | — | 5 | 2 | 0 | 6 |
| Ex. 18 | 94.55 | 94 | — | 9 | 2.2 | 1 | 7 |
| Ex. 19 | 94.55 | 94 | — | 15 | 3.3 | 1 | 7 |
| Ex. 20 | 94.55 | 94 | — | 20 | 5.8 | 4 | 7 |
| Comp. Ex. 7 | 94.55 | 94 | — | 0 | 6.9 | 5 | 4 |
| Comp. Ex. 8 | 94.55 | 94 | — | 25 | 9.5 | 8 | 3 |

TABLE 4

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 21 | 94.55 | 92 | 1 | — | 2.7 | 0 | 8 |
| Ex. 22 | 94.55 | 92 | 5 | — | 2 | 0 | 9 |
| Ex. 23 | 94.55 | 92 | 9 | — | 2.8 | 1 | 8 |
| Ex. 24 | 94.55 | 92 | 15 | — | 3.8 | 1 | 8 |
| Ex. 25 | 94.55 | 92 | 20 | — | 5.1 | 3 | 7 |
| Comp. Ex. 9 | 94.55 | 92 | 0 | — | 6.2 | 6 | 5 |
| Comp. Ex. 10 | 94.55 | 92 | 25 | — | 7.2 | 7 | 6 |
| Ex. 26 | 94.55 | 92 | — | 1 | 2.8 | 0 | 7 |
| Ex. 27 | 94.55 | 92 | — | 5 | 2.1 | 0 | 6 |
| Ex. 28 | 94.55 | 92 | — | 9 | 2.8 | 1 | 7 |
| Ex. 29 | 94.55 | 92 | — | 15 | 3.7 | 1 | 7 |
| Ex. 30 | 94.55 | 92 | — | 20 | 5.5 | 3 | 8 |
| Comp. Ex. 11 | 94.55 | 92 | — | 0 | 6.8 | 6 | 6 |
| Comp. Ex. 12 | 94.55 | 92 | — | 25 | 9.3 | 9 | 6 |

TABLE 5

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 31 | 94.55 | 90 | 1 | — | 3.9 | 0 | 8 |
| Ex. 32 | 94.55 | 90 | 5 | — | 4.2 | 0 | 9 |
| Ex. 33 | 94.55 | 90 | 9 | — | 4.6 | 2 | 8 |
| Ex. 34 | 94.55 | 90 | 15 | — | 4.9 | 3 | 8 |
| Ex. 35 | 94.55 | 90 | 20 | — | 5.1 | 3 | 7 |
| Comp. | 94.55 | 90 | 0 | — | 6.3 | 5 | 6 |

TABLE 5-continued

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 13 | | | | | | | |
| Comp. Ex. 14 | 94.55 | 90 | 25 | — | 7.2 | 5 | 7 |
| Ex. 36 | 94.55 | 90 | — | 1 | 3.9 | 1 | 8 |
| Ex. 37 | 94.55 | 90 | — | 5 | 4.2 | 2 | 7 |
| Ex. 38 | 94.55 | 90 | — | 9 | 4.7 | 2 | 7 |
| Ex. 39 | 94.55 | 90 | — | 15 | 4.8 | 2 | 8 |
| Ex. 40 | 94.55 | 90 | — | 20 | 5.4 | 2 | 6 |
| Comp. Ex. 15 | 94.55 | 90 | — | 0 | 6.3 | 4 | 5 |
| Comp. Ex. 16 | 94.55 | 90 | — | 25 | 8.7 | 7 | 4 |

TABLE 6

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 41 | 94.55 | 88 | 1 | — | 4.2 | 2 | 9 |
| Ex. 42 | 94.55 | 88 | 5 | — | 4.6 | 2 | 10 |
| Ex. 43 | 94.55 | 88 | 9 | — | 4 | 2 | 10 |
| Ex. 44 | 94.55 | 88 | 15 | — | 5.4 | 3 | 10 |
| Ex. 45 | 94.55 | 88 | 20 | — | 6 | 4 | 10 |
| Comp. Ex. 17 | 94.55 | 88 | 0 | — | 6 | 5 | 5 |
| Comp. Ex. 18 | 94.55 | 88 | 25 | — | 8 | 6 | 7 |
| Ex. 46 | 94.55 | 88 | — | 1 | 4.3 | 2 | 8 |
| Ex. 47 | 94.55 | 88 | — | 5 | 4.7 | 2 | 9 |
| Ex. 48 | 94.55 | 88 | — | 9 | 5 | 2 | 9 |
| Ex. 49 | 94.55 | 88 | — | 15 | 5.4 | 3 | 9 |
| Ex. 50 | 94.55 | 88 | — | 20 | 6 | 4 | 9 |
| Comp. Ex. 19 | 94.55 | 88 | — | 0 | 6 | 5 | 5 |
| Comp. Ex. 20 | 94.55 | 88 | — | 25 | 8 | 6 | 6 |

TABLE 7

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 51 | 94.55 | 95.8 | 1 | — | 2 | 0 | 7 |
| Ex. 52 | 94.55 | 95.8 | 5 | — | 1.9 | 1 | 8 |
| Ex. 53 | 94.55 | 95.8 | 9 | — | 1.6 | 1 | 8 |
| Ex. 54 | 94.55 | 95.8 | 15 | — | 2.5 | 1 | 8 |
| Ex. 55 | 94.55 | 95.8 | 20 | — | 5.7 | 3 | 9 |

TABLE 7-continued

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Comp. Ex. 51 | 94.55 | 95.8 | 0 | — | 6.2 | 5 | 4 |
| Comp. Ex. 52 | 94.55 | 95.8 | 25 | — | 8.1 | 7 | 6 |

TABLE 8

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 61 | 94.55 | 96.5 | 1 | — | 2.1 | 0 | 9 |
| Ex. 62 | 94.55 | 96.5 | 5 | — | 1.8 | 0 | 9 |
| Ex. 63 | 94.55 | 96.5 | 9 | — | 1.4 | 0 | 9 |
| Ex. 64 | 94.55 | 96.5 | 15 | — | 2.3 | 1 | 9 |
| Ex. 65 | 94.55 | 96.5 | 20 | — | 5.1 | 3 | 9 |
| Comp. Ex. 61 | 94.55 | 96.5 | 0 | — | 6.2 | 5 | 4 |
| Comp. Ex. 62 | 94.55 | 96.5 | 25 | — | 7.5 | 7 | 6 |

TABLE 9

| | L* of paper | L* of toner image | Pigment having a complementary relationship: Copper phthalo-cyanine (ppm) | Pigment having a complementary relationship: Cobalt aluminate (ppm) | ΔE * ab | Difference felt between paper and image (of 10 experts) | Definition of image quality (of 10 experts) |
|---|---|---|---|---|---|---|---|
| Ex. 71 | 94.55 | 96 | 1 | — | 3.5 | 0 | 9 |
| Ex. 72 | 94.55 | 96 | 5 | — | 2.5 | 0 | 9 |
| Ex. 73 | 94.55 | 96 | 9 | — | 2.4 | 0 | 9 |
| Ex. 74 | 94.55 | 96 | 15 | — | 4.5 | 1 | 9 |
| Ex. 75 | 94.55 | 96 | 20 | — | 5.1 | 3 | 9 |
| Comp. Ex. 71 | 94.55 | 96 | 0 | — | 6.2 | 5 | 4 |
| Comp. Ex. 72 | 94.55 | 96 | 25 | — | 7.5 | 7 | 6 |

[Industrial Applicability]

The image forming method and image forming apparatus according to the invention are particularly useful for electrophotography and electrostatic recording method.

What is claimed is:

1. An electrostatic image developing toner comprising:

a binder resin; and a copper phthalocyanie pigment having a complementary relationship with a color hue of the binder resin, the pigment being contained in an amount of from 15 ppm to 20 ppm.

2. The electrostatic image developing toner according to claim 1, wherein the binder resin is a polyester resin.

3. The electrostatic image developing toner according to claim 2, wherein the polyester resin has a bisphenol skeleton.

4. The electrostatic image developing toner according to claim 1, wherein the toner is prepared by aggregating particles containing at least the binder resin in a dispersion in which the particles are dispersed to obtain aggregated particles and by heating and fusing the aggregated particles, and the binder resin contains a polyester resin in an amount of about 70 mass % or greater but not greater than about 100 mass %.

5. The electrostatic image developing toner according to claim 1, wherein the binder resin contains a crystalline polyester resin in an amount of about 1 mass % or greater but not greater than about 30 mass %.

6. The electrostatic image developing toner according to claim 1, further comprising a releasing agent, which is a polyolefin.

7. An electrostatic image developer comprising:

the electrostatic image developing toner as claimed in claim 1; and a carrier.

8. An image forming method, comprising at least:

charging an image holding member;

forming a latent image on the image holding member;

developing the latent image on the image holding member by using the electrostatic image developer as claimed in claim 7 to form a toner image;

primarily transferring the developed toner image to an intermediate transfer member;

secondarily transferring the toner image transferred to the intermediate transfer member to a recording medium; and fixing the toner image by using at least heat or pressure.

9. An electrostatic image developing toner comprising:

a binder resin;

a releasing agent; and a copper phthalocyanine pigment having a complementary relationship with a color hue of the binder resin, the pigment being contained in an amount from 15 ppm to 20 ppm, wherein assuming that a color difference $\Delta E^*ab$ is defined as $\Delta E^*ab=[(\Delta a^*)^2+(\Delta b^*)^2+(\Delta L^*)^2]^{1/2}$, the color difference $\Delta E^*ab$ between a recording medium and a toner image is about 5 or less, after the toner is fixed onto the recording medium with a toner amount thereon being 10 $g/m^2$.

10. An electrostatic image developing toner comprising:

a binder resin; and a copper phthalocyanine pigment having a complementary relationship with a color hue of the binder resin, the pigment being contained in an amount of from 15 ppm to 20 ppm, wherein the electrostatic image developing toner is a colorless transparent toner.

* * * * *